US005690299A

United States Patent [19]

Perrin et al.

[11] Patent Number: 5,690,299

[45] Date of Patent: Nov. 25, 1997

[54] DISPENSER FOR FEEDING SHEET MATERIAL FROM SEQUENTIAL ROLLS

[75] Inventors: Patrick C. Perrin, Rancho Palos Verdes; Jimmie L. Whittington, deceased, late of Diamond Bar, both of Calif., by Eleanor Whittington, Legal Representative

[73] Assignee: Perrin Manufacturing, City of Industry, Calif.

[21] Appl. No.: 746,462

[22] Filed: Nov. 12, 1996

[51] Int. Cl.[6] ..... B65H 19/10

[52] U.S. Cl. ..... 342/560; 242/597.5

[58] Field of Search ..... 242/560, 560.1, 242/560.2, 594.5, 597, 597.5, 597.8

[56] References Cited

U.S. PATENT DOCUMENTS

| | | | |
|---|---|---|---|
| 2,299,301 | 10/1942 | Britt et al. . | |
| 3,126,234 | 3/1964 | Batlas et al. | 242/560 |
| 3,381,909 | 5/1968 | Tucker et al. | 242/597.5 |
| 3,387,902 | 6/1968 | Perrin et al. . | |
| 3,677,485 | 7/1972 | Berg . | |
| 3,690,580 | 9/1972 | Jespersen . | |
| 3,770,222 | 11/1973 | Jespersen . | |
| 4,422,584 | 12/1983 | Dashnier et al. . | |
| 4,422,585 | 12/1983 | Schultz et al. . | |

*Primary Examiner*—John P. Darling
*Attorney, Agent, or Firm*—Sheldon & Mak

[57] ABSTRACT

A dispenser includes an openable housing having a front opening, a parallel-spaced pair of guide slots being supported proximate opposite sides of the housing, each guide slot having a generally vertically oriented first segment, a generally horizontally oriented second segment intersecting the first segment, and a generally vertically oriented third segment intersecting the second segment in offset relation to the first segment, the first segment having a bottom extremity below the second segment. A dual mandrel has parallel-spaced portions for receiving respective rolls, and a bridge portion rigidly connecting the mandrel portions. The dual mandrel, is locatable with opposite ends of each mandrel portion guidable from a first position wherein a lowermost of the mandrel portions is in a first dispensing position at the bottom extremity of the first segment, the other mandrel portion being in a reserve position and, following substantial consumption of the sheet material from the lowermost mandrel, to a second position wherein the lowermost of the mandrel portions is in an expended position at a bottom extremity of the third segment of the guide slot, and the other mandrel portion is in a second dispensing position within the first segment. A catch member is biasingly coupled to the housing for retaining the lowermost of the mandrel portions in the expended position.

13 Claims, 4 Drawing Sheets

DISPENSER FOR FEEDING SHEET MATERIAL FROM SEQUENTIAL ROLLS

BACKGROUND

The present invention relates to fixtures for dispensing sheet material from rolls, and more particularly to dispensers that are adapted for feeding from a presented roll, and from a spare roll following exhaustion of the presented roll, as in toilet tissue dispensers and the like.

Dual roll sheet dispensers are well known, being disclosed, for example, in U.S. Pat. Nos. 3,387,902 to Perrin et al., 3,770,222 to Jespersen, 4,422,584 to Dashnier et al., and 4,422,585 to Schultz et al. Typically, such dispensers have one roll supported in a first dispensing position, and an additional roll is held in a reserve position and moved to a second dispensing position (which in some cases is the same as the first dispensing position) following or upon exhaustion of the first roll. Perrin et al. disclose a U-shaped mandrel assembly having mandrel components that are movable in a rigid yoke member, the assembly being loadable with rolls having split cores. Once the mandrel assembly is loaded into the dispenser, the respective rolls are locked in respective dispensing and reserve positions until the dispensing roll is exhausted, whereupon its core is burst automatically by spring action of the mandrel assembly, whereupon the assembly is allowed to fall to a lower position within the dispenser, whereby the mandrel components for the exhausted roll move to an exhausted position and the remaining roll moves from the reserve position to a secondary dispensing position.

Jespersen discloses a roll paper dispenser having a pair of generally L-shaped guide channels for opposite ends of a pair of mandrels, with movable members of the dispenser permitting downward movement of the mandrels in a prescribed manner, with the dispensing position shifting in response to consumption of the lower roll until the respective mandrel becomes disengaged from the guide channels, whereupon the upper mandrel is released from the reserve position.

Dashnier et al. disclose a dispenser having a pair of oppositely cantilevered mandrels that are pivotally supported on a common axis in a manner permitting limited relative angular movement, the upper mandrel being detented in the reserve position until dislodged therefrom by movement of the lower mandrel, such movement being blocked until the lower roll is nearly consumed. Shultz et al. disclose a similar dispenser wherein first and second mandrels are each cantilevered from respective guide blocks that slide in respective legs of an L-shaped track. The first mandrel is retained in the reserve position by interference between the blocks until the roll on the second mandrel is nearly exhausted.

The roll sheet dispensers of the prior art have not been entirely satisfactory for at least some of the following reasons:

1. They are wasteful in that they do not provide for complete consumption of one roll before initiating consumption of the reserve roll;
2. They are not versatile in that they require special or proprietary roll configurations;
3. They are awkward to use in that partially consumed reserve rolls must be removed from their mandrels and either discarded or reloaded onto a different mandrel, and the loaded mandrels must be carefully guided into engagement with tracks or other supports; and 4. They are expensive to provide and difficult to maintain in that they incorporate complex mechanisms and interlocks.

Thus there is a need for a sequential roll sheet dispenser that overcomes the disadvantages of the prior art.

SUMMARY

The present invention meets this need by providing a dispenser having a symmetrical one-piece dual mandrel. In one aspect of the invention, an apparatus for dispensing sheet material includes a base panel for mounting to a supporting structure and defining a parallel-spaced pair of vertically oriented coplanar panel guide surfaces; a pair of parallel-spaced base track members rigidly projecting from the base, each base track member having first and second guide surface segments, each first guide surface segment extending approximately parallel to a corresponding panel guide surface, each second guide surface being inclined relative to the first guide surface and forming a continuation of the corresponding first guide surface; a cover unit openably connectable to the base panel and having latch means for holding the cover unit in a closed position relative to the base panel, the cover unit having a front wall portion and respective side wall portions; a pair of parallel spaced cover track members rigidly extending in facing relation relative to corresponding ones of the side wall portions, each cover track member having a first guide surface segment, a second guide surface segment, and a transition segment wherein, when the cover unit is in the closed position, the first guide surface segments of the respective base and cover track segments extend in approximately uniformly spaced relation, the second guide surface segments of the respective base and cover track segments extend in spaced relation, and the transition segments extend in concave relation between proximal ends of the first and second guide surface segments of the cover track members thereby to form respective notch-shaped track passages. The apparatus also includes a mandrel unit having a parallel-spaced pair of mandrel portions and a bridge portion rigidly connecting the mandrel portions, the mandrel unit being locatable between the base panel and the cover unit with opposite ends of each mandrel portion guidable within respective ones of the track passages in the closed position of the cover unit, one of the mandrel portions being movable between a first dispensing position to an expended position, the other of the mandrel portions being correspondingly moved from a reserve position to a second dispensing position.

Further guide surface segments of the base panel and cover unit can define respective extensions of the corresponding track passages, the expended position of the mandrel portion being within the extensions. Preferably the apparatus further includes a catch member for holding the mandrel portion in the expended position thereof.

In another aspect of the invention, an apparatus for dispensing sheet material from a plurality of cored rolls includes an openable housing having opposite side portions and a front opening, a parallel-spaced pair of guide slots being supported proximate respective ones of the side portions, each guide slot having a generally vertically oriented first segment, a generally horizontally oriented second segment intersecting the first segment, and a generally vertically oriented third segment intersecting the second segment in offset relation to the first segment, the first segment having a bottom extremity below the second segment; a mandrel member having a parallel-spaced pair of mandrel portions for receiving respective ones of the rolls, and a bridge portion rigidly connecting the mandrel portions, the mandrel member when loaded with the rolls being locatable with opposite ends of each mandrel portion guidable within respective ones of the guide slots from a first position wherein a lowermost of the mandrel portions is in a first dispensing position at the bottom extremity of the first segment, and an uppermost of the mandrel portions is in a reserve position within the first segment; and, following substantial consumption of the sheet material from the lowermost mandrel, to a second position wherein the lowermost of the mandrel portions is in an expended position at a bottom extremity of the third segment of the guide slot, and the uppermost of the mandrel portions is in a second dispensing position within the first segment; and a catch member biasingly coupled to the housing for retaining the lowermost of the mandrel portions in the expended position.

Preferably the base panel is effective for preventing engagement of the lowermost mandrel portion with the third segment of the guide slot until the sheet material is substantially consumed therefrom. Preferably each mandrel portion has a latch surface formed thereon for engagement by the catch member when the mandrel member is engaging the guide slot with one mandrel portion in the expended position, the engagement of the latch surface by the catch member locking the one mandrel portion in the expended position. The mandrel member can be locatable in the guide slots with either of the mandrel portions being the lowermost mandrel portion. Preferably the mandrel member is also locatable in the guide slots with either end extremity of each mandrel portion being within either of the guide slots for facilitating loading of the mandrel member into the housing.

Preferably the housing includes a base portion and a cover portion, the cover portion having open and closed positions relative to the base portion, opposite sides of the first segments of each guide slot being formed respectively in the base and cover portions, whereby the mandrel member is laterally separable from the housing in the open position of the cover portion. The cover portion can be separable from the base portion. Preferably the mandrel member is lowerable into the cover portion to stable engagement with portions of the first segments of the guide slot, the mandrel member remaining in the stable engagement during movement of the cover portion to the closed position thereof for facilitating servicing of the dispenser.

In a further aspect of the invention, a method for dispensing sheet material from a plurality of cored rolls thereof, includes the steps of:

(a) providing a dispenser having a dual mandrel and a housing, the housing including a base portion and an openable cover portion having a closed position, opposite guide slots being formed between respective guide surfaces of the base portion and the cover portion in the closed position thereof for defining respective first and second dispensing positions, a reserve position, and an expended position for the rolls;

(b) loading a pair of the rolls on respective portions of the mandrel;

(c) opening the cover portion to an orientation wherein the guide surfaces thereof are upwardly facing;

(d) lowering the mandrel into engagement with the guide surfaces of the cover portion; and (e) closing the cover portion with the rolls in the first dispensing and reserve positions thereof.

The method can include the further steps of:

(a) unrolling and separating material from the roll having the first dispensing position until substantially all of the material is removed therefrom;

(b) moving the mandrel until a portion thereof is in the expended position, the roll in the reserve position being thereby moved to the second dispensing position; and (c) retaining the roll in the second dispensing position.

DRAWINGS

These and other features, aspects, and advantages of the present invention will become better understood with reference to the following description, appended claims, and accompanying drawings, where:

DESCRIPTION

Figure 1:
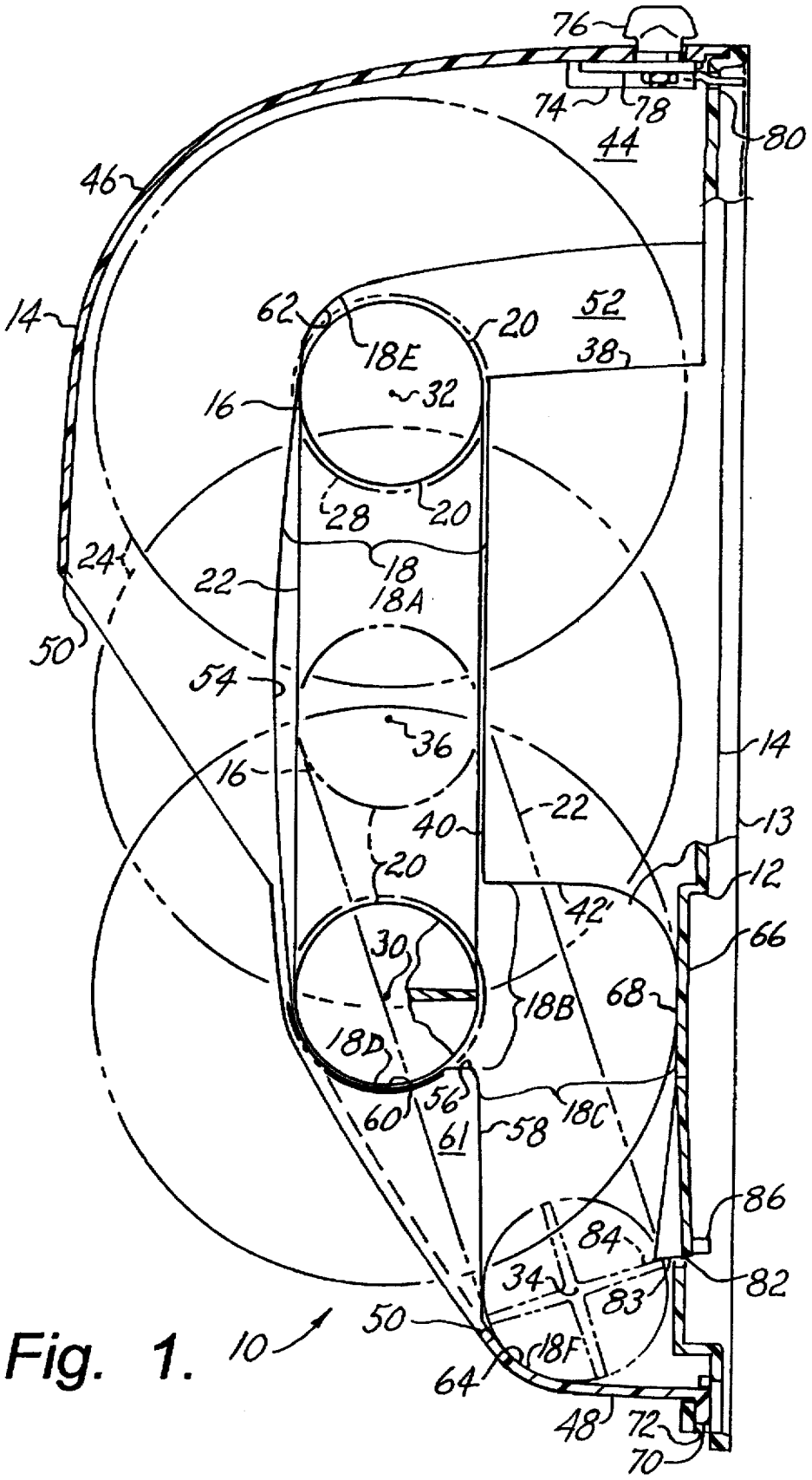
FIG. 1 is a fragmentary side sectional elevational view of a dual-roll sheet dispenser according to the present invention.

The present invention is directed to a dual sequential dispenser for sheet material on rolls, that is particularly effective in commercial and institutional applications, yet inexpensive to provide. With reference to FIGS. 1–4 of the drawings, a dispenser 10 according to the resent invention has a base 12 for mounting to a wall surface 13, a cover 14, and a dual mandrel 16 that is movable within a laterally spaced pair of tracks or guide slots 18 that are formed between the base 12 and the cover 14 as further described below. The base 12 defines a conventional planar mounting surface 13 for mounting the dispenser 10 on a vertical panel in any suitable manner. The dual mandrel 16 has a parallel-spaced pair of mandrel portions 20 that are rigidly connected by a bridge portion 22, the bridge portion 22 extending between the mandrel portions 20 proximate respective end extremities thereof. Each of the mandrel portions 20 has an outside diameter D, being adapted for receiving a conventional roll 24 of sheet material 26, the material 26 having a width W and being wound on a disposable core 28. The sheet material 26 can be paper of the type used for towels, for toilet tissue, or other similar sheet material. In the exemplary configuration of the dispenser 10 as shown in FIGS. 1–4, toilet tissue is contemplated, the width W being approximately 4.56 inches.

The guide slot 18 is segmented, having a generally vertical first portion 18A, a generally horizontal second portion 18B, and another generally vertical third portion 18C. The guide slot 18 is further characterized by a fourth portion 18D being a lower extremity of the first portion 18A that is depressed below the second portion 18B; a fifth portion 18E defining an upper extremity of the first portion 18A; and a sixth portion 18F defining a lower extremity of the third portion 18C. The dual mandrel 16 is thus locatable with a pair of the rolls 24 loaded on the mandrel portions 20 in a main position within the guide slot first portion 18A, the mandrel 16 being supported on the fourth portion 18D as shown by solid lines in FIG. 1. In this condition, the lowermost of the rolls 24 (and the corresponding mandrel portion 20) is in a first dispensing position as indicated at 30, and the uppermost of the rolls 24 (and the corresponding mandrel portion 20) is in a reserve position as indicated at 32. After the roll 24 in the first dispensing position 30 has been substantially emptied of the material 26, the dual mandrel 16 is locatable as further described below with the lowermost mandrel portion 20 resting on the sixth guide slot portion 18F in an expended position as indicated at 34 by dashed lines in FIG. 1, the uppermost mandrel portion 20 (and the corresponding roll 24) being in a second dispensing position as indicated at 36.

An important and preferred feature of the exemplary embodiment of the dispenser 10 as shown in the drawings is that the base 12 defines one side of each guide slot 18, the openable cover 14 defining the opposite side of the respective guide slot 18 as described herein. As best shown in FIG. 1, the base 12 is formed including an outwardly projecting flange portion 38, there being a laterally spaced pair of such flange portions 38 shown in FIG. 2. Each flange portion 38 has a first guide surface 40 for defining a rear boundary of the first guide slot portion 18A, and a second guide surface 42 for defining an upper boundary of the second guide slot portion 18B. The cover 14 is formed with opposite side walls 44, a curved top wall 46, and a bottom wall 48, a front opening 50 being defined between inner extremities of the respective walls 44, 46, and 48. Respective inside faces of the side walls 44 have track recesses 52 formed therein, a front extremity of each recess 52 forming a third guide surface 54 for defining a front boundary of the first guide slot portion 18A. Similarly, a fourth guide surface 56 extends in generally perpendicular relation to the third guide surface 54 for defining a lower boundary of the second guide slot portion 18B, and a fifth guide surface 58 intersects the fourth guide surface 56, extending in offset relation to the third guide surface 54 for defining a front extremity of the third guide slot portion 18C. A concavely curved sixth guide surface 60 intersects the fourth guide surface 56, extending tangentially from the third guide surface for defining a bottom extremity of the first guide slot portion 18A. The guide surfaces 56, 58, and 60 are formed on a laterally spaced pair of flange portions 61 of the cover 14, the flange portions 61 being spaced inwardly from opposite sides of the cover 14 and defining portions of the front opening 50. A concavely arcuate seventh guide surface 62 extends tangentially from the third guide surface for defining a top extremity of the first guide slot portion 18A, the first guide surface 40 extending upwardly beyond the point of tangency for blocking rearward movement of a mandrel portion 20 from the reserve position 32. Also, the first guide slot 18A extends upwardly sufficiently for permitting the uppermost mandrel portion 20 to be raised slightly above the reserve position 32, for permitting the lowermost mandrel portion 20 to be moved over the fourth guide surface 56, the fourth guide surface 56 being above the bottom of the sixth guide surface 60. An inside face of the bottom wall 48 provides an eighth guide surface 64 for defining the bottom extremity of the third guide slot portion 18C. Finally, a raised rear wall portion 66 of the base 12 provides a ninth guide surface 68 for defining a rear boundary of the third guide slot portion 18C. The third guide surface 54 is sometimes referred to as a first guide surface of the cover 14. Similarly, the fourth guide surface 56 is sometimes referred to as a second guide surface of the cover 14; the fifth guide surface 58 sometimes being referred to as a third guide surface of the cover 14, the sixth guide surface 60 sometimes being referred to as a fourth guide surface of the cover 14; and the seventh guide surface 62 sometimes being referred to as a fifth guide surface of the cover 14. The respective guide surfaces of the base 12 and the cover 14 thus are associated with corresponding portions 18A, 18B, 18C, 18D, and 18E of the guide slot 18.

Figure 4:
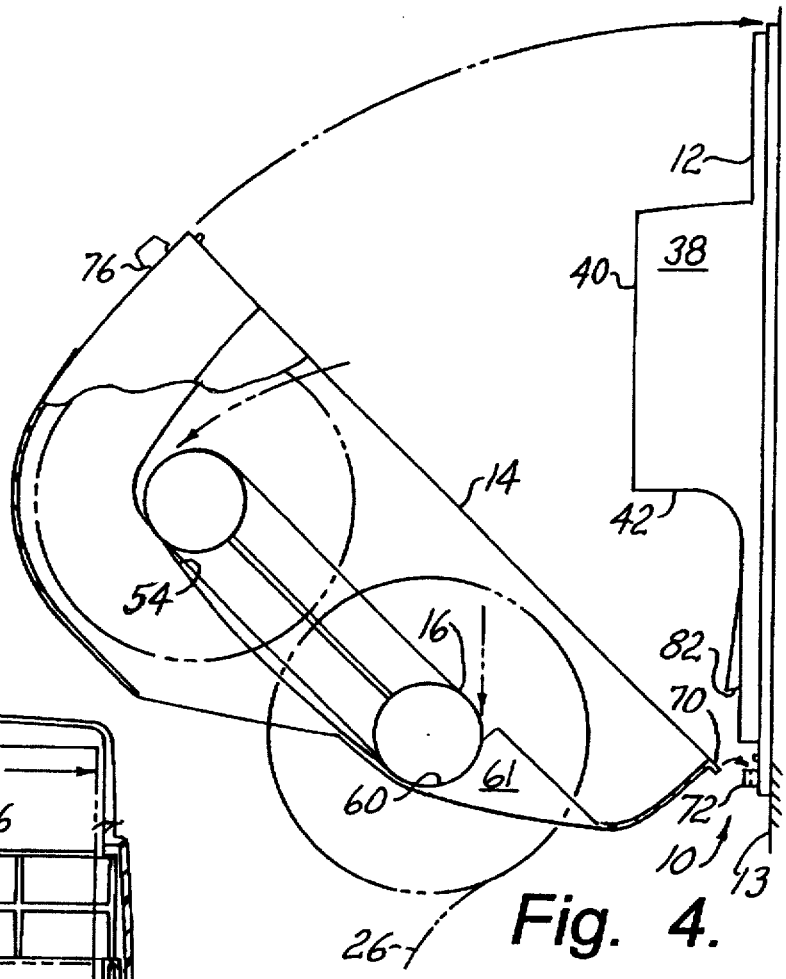
FIG. 4 is a sectional elevational view as in FIG. 1, showing a loading sequence of the dispenser of FIG. 1.
Figure 2:
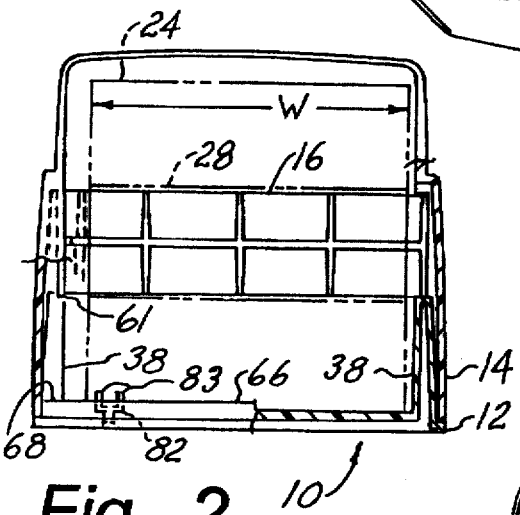
FIG. 2 is a fragmentary bottom plan sectional view of the dispenser of FIG. 1.

This separable construction of the guide slots 18 advantageously permits the dual mandrel 16 to be inserted laterally into engagement with the third guide surfaces 54 of the cover 14 in an open position thereof as shown in FIG. 4, the cover 14 then being closed onto the base 12 without the mandrel 16 being disloged from engaging the guide surfaces 54. More particularly, the cover 14 has a laterally spaced pair of retainer tabs 70 extending from the bottom wall 48 for engaging corresponding tab cavities 72 that are formed proximate a bottom extremity of the base 12. A conventional finger latch 74 is mounted proximate a rear extremity of the top wall 46, the latch 74 having a thumbturn 76 and pair of movable finger members 78 for releasably engaging a catch portion 80 of the base 12 in the closed position of the cover 14 as shown in FIG. 1. When the latch 74 is in a released condition, the cover 14 is openable by outwardly swinging the top wall 46 until the retainer fingers are separable from the finger cavities 72. A preferred open position orientation of the cover 14 for loading the dual mandrel 16 is inclined approximately as shown in FIG. 4, the third guide surfaces 52 extending upwardly and outwardly from the sixth guide surfaces 60. The dual mandrel 16 (with the rolls 24 loaded thereon) is next lowered such that one of the mandrel portions 20 comes into engagement with the sixth guide surfaces 60 as indicated by the downward directed arrow in FIG. 4, the other mandrel portion 20 being moved into engagement with the third guide surface 52 by pivoting about the sixth guide surface 60 as indicated by the counterclockwise arrow in FIG. 4. The mandrel 16 remains in stable engagement with the third guide surface 52, being supported on the sixth guide surface 60 during replacement of the cover 14 as indicated by the clockwise arrows in FIG. 4. Once the cover 14 is closed, the dual mandrel 16 locates the lowermost of the rolls 24 in the first dispensing position 30 and the other roll 24 in the reserve position 32 as described above.

Figure 3:
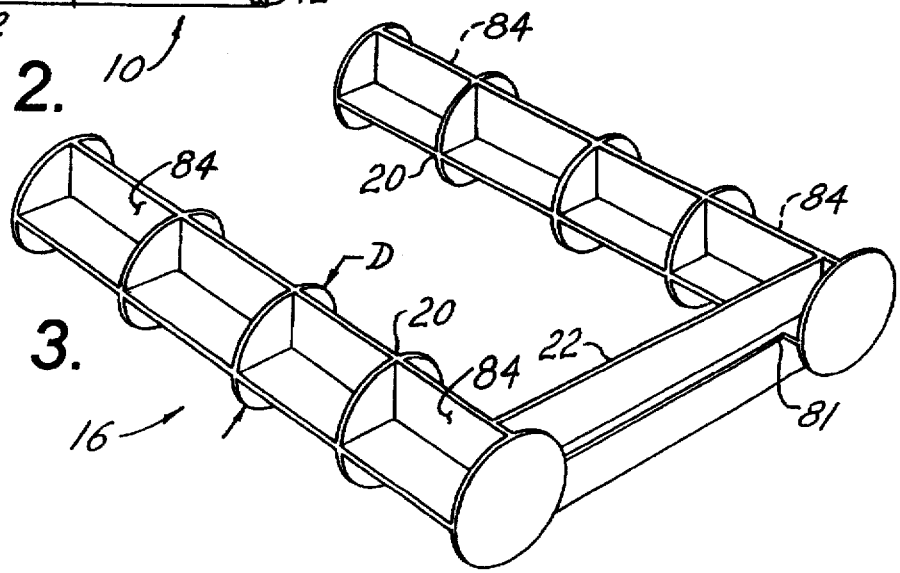
FIG. 3 is an oblique elevational perspective view of a dual mandrel of the dispenser of FIG. 1.

As further shown in FIG. 3, the mandrel 16 is notched as indicated at 81, thus narrowing the bridge portion 22 for clearing the flange portions 38 of the base 12 during movement of the mandrel portion 20 between the first dispensing position 30 to the expended position 34.

A laterally spaced pair of holder portions 82 are integrally formed with the raised rear wall portion 66 of the base 12 for holding the lowermost mandrel portion 22 once the mandrel portion 22 has been moved into the expended position 34, each of the holder portions 82 being formed as a pair of projecting tines 83 that are biased into an interfering relation with the lowermost mandrel portion 20 and/or the core 28 that may be thereon. Also, the tines 83 are oriented for biting into the core 28, thereby more positively preventing movement of the mandrel portion 20 from the expended position 34. The mandrel 16 is released from its retained position upon opening of the cover 14.

It is contemplated that the dispenser 10 will be used with the rolls 24 having conventional paper cores 28. It is also contemplated that the cores 28 can be of the "bursting" type that are sometimes used in industrial and institutional applications. The bursting cores are intended to come apart after the material 26 is fully exhausted, leaving the mandrel portion 20 bare. The dispenser 10 of the present invention is adapted to firmly retain the mandrel portion 20 in the expanded position 34, even in the absence of the core 28. Particularly, the dual mandrel 16 has a plurality of catch portions 84 formed therein for positive engagement by the tines 83 of the holder portions 82. As described above, the catch portions 84 in the configuration of FIGS. 1–4 are located for biasing engagement with the core 28 or the mandrel 16 in the absence of the core 28, the catch portions 84 being integrally formed with the base 12 as best shown in FIG. 1. Each of the holder portions 82 is provided with a stop portion 86 for preventing excessive deflection away from the guide slot portion 18C.

Figure 7:
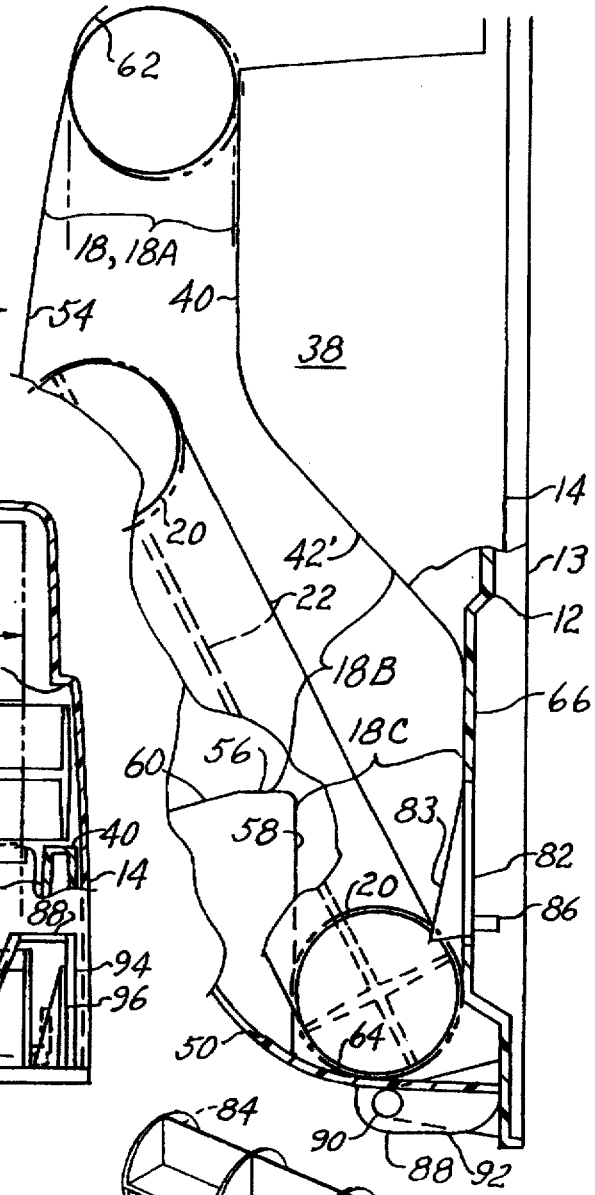
FIG. 7 is a partial sectional elevational view as in FIG. 1 of the dispenser of FIG. 5.
Figure 5:
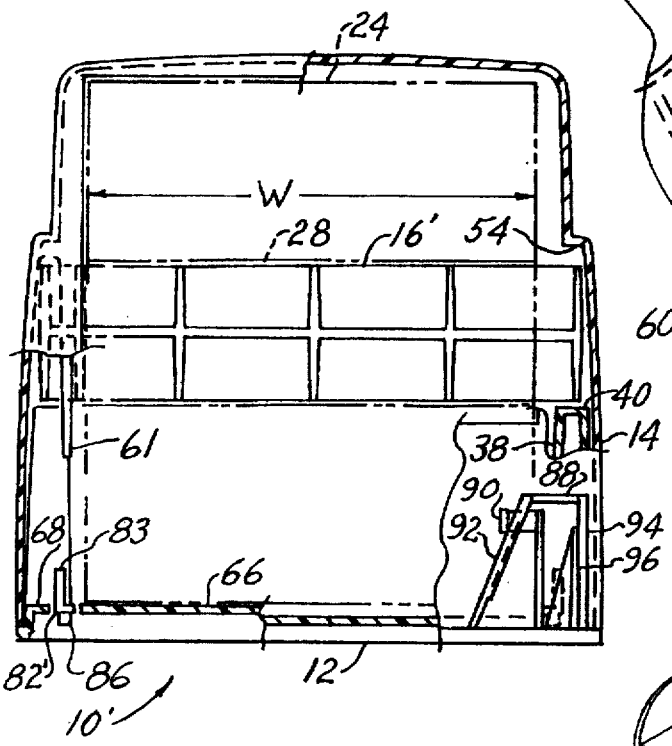
FIG. 5 is a sectional view as in FIG. 2, showing an alternative configuration of the dispenser of FIG. 1.
Figure 6:
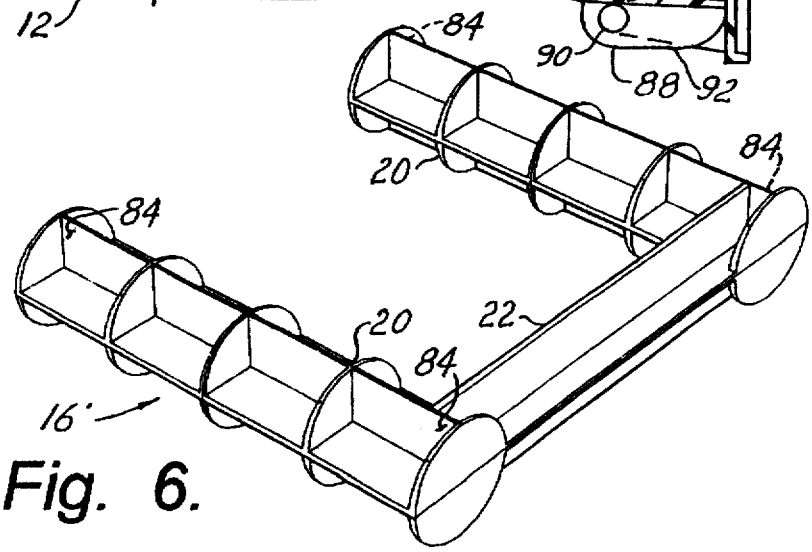
FIG. 6 is a perspective view as in FIG. 3, showing a dual mandrel of the dispenser of FIG. 5.
Figure 9:
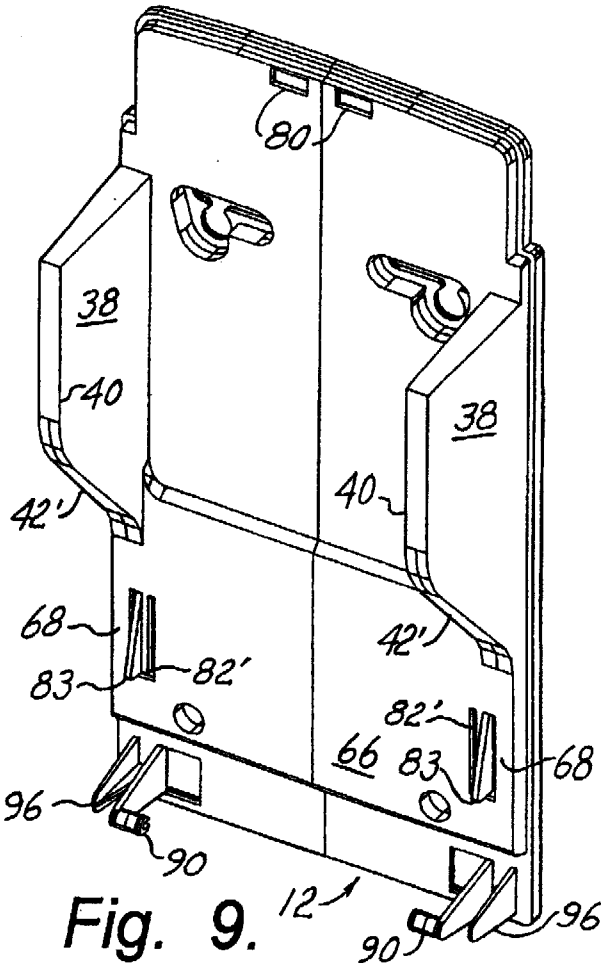
FIG. 9 is a rear oblique elevational perspective view of a cover unit portion of the dispenser of FIG. 5.
Figure 8:
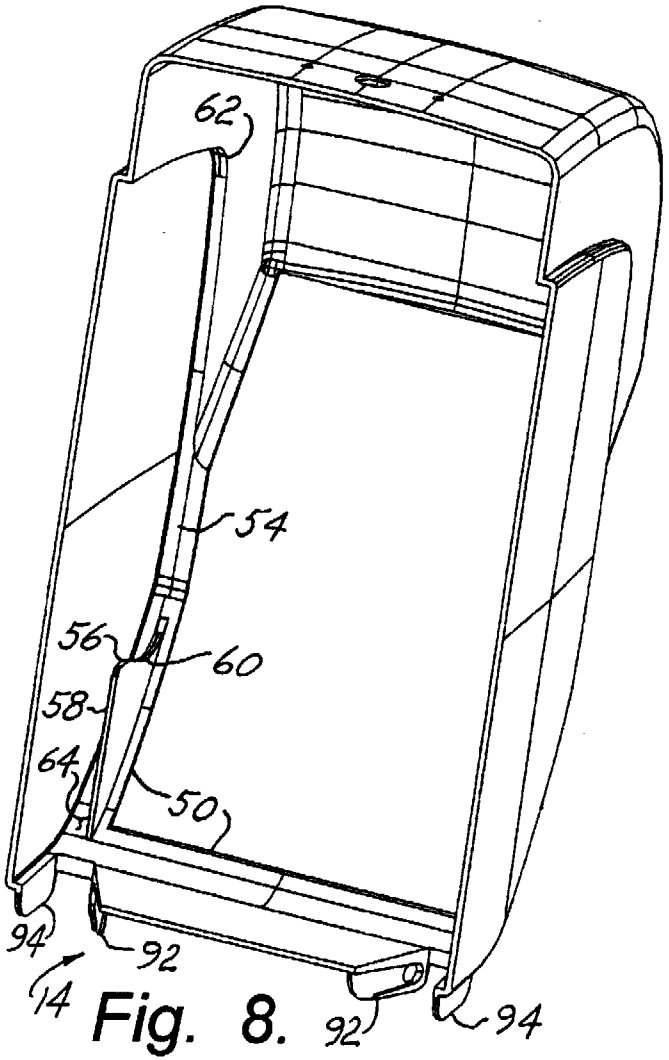
FIG. 8 is a front oblique elevational perspective view of a base panel portion of the dispenser of FIG. 5.

With further reference to FIGS. 5–9, an alternative configuration of the dispenser, designated 10', has a counterpart of the mandrel, designated 16', strengthened by not being formed with the notch 81 (FIG. 3). Clearance for the bridge portion 22 is provided during movement of the mandrel 16' to the expended position 34 by forming the flange portions 38 of the base 12 with counterparts of the second guide surface, designated 42', sloping upwardly and outwardly from the rear wall portion 66 of the base 12 as best shown in FIG. 7. In this configuration of the dispenser 10', it will be understood that the second guide slot portion 18B extends generally horizontally between the first guide slot portion 18A and the third guide slot portion 18C, notwithstanding the sloping second guide surface 42', in that the lowermost mandrel portion 20 is constrained to more generally horizontally by the fourth guide surface 56 between the first dispensing position 30 and the third guide slot portion 18C.

In other aspects, the dispenser 10' includes a snap-together hinge connection 88 in place of the retainer tabs 70 and tab cavities 74, the hinge connection 88 including a pair of hinge pin stanchions 90 that project outwardly from the base 12 into pivotal engagement with respective inclined flange portions 92 of the cover 14. The cover 14 also has a parallel-spaced pair of alignment flange portions 94 that straddle a pair of alignment stanchions 96 of the base 12 for maintaining lateral alignment of the base 12 and the cover 14 in the open position thereof. The hinge connection 88 supports the cover 14 in the open position aligned with the base 12, advantageously leaving both hands of an attendant free for manipulation of the mandrel 16' and the rolls 24 during servicing of the dispenser 10'.

Also, the dispenser 10' has counterparts of the holder portions, designated 82', spaced outwardly from the core 28, the tine portions 83 thereby engaging the catch portions 84 of the mandrel 16' only for more positively holding the mandrel 16' in the expended position 34. Each of the holder portions 82' is provided with only one of the tines 83. Further, the dispenser 10' is configured for centering the rolls 24 between the guide slots 18, regardless of the orientation of the mandrel 16', as best seen by a comparison of FIGS. 2 and 5, wherein the front opening 50 is centered between opposite sides of the cover 14. For this purpose, the flange portions 61 of the cover 14 are spaced outwardly from the front opening 50 for clearing the bridge portion 22 of the mandrel 16'.

Although the present invention has been described in considerable detail with reference to certain preferred versions thereof, other versions are possible. For example, different combinations of the variations between the dispenser 10 of FIGS. 1–4 and the dispenser 10' of FIGS. 5–9 can be configured. Also, a locking latch can be used in place of the finger latch 74. Therefore, the spirit and scope of the appended claims should not necessarily be limited to the description of the preferred versions contained herein.

What is claimed is:

1. Apparatus for dispensing rolled sheet material, comprising:

(a) a base panel for mounting to a supporting structure and defining a parallel-spaced pair of vertically oriented coplanar panel guide surfaces;

(b) a pair of parallel-spaced base track members rigidly projecting from the base pavel, each base track member having first and second guide surface segments, each first guide surface segment extending approximately parallel to a corresponding panel guide surface, each second guide surface being inclined relative to the first guide surface and forming a continuation of the corresponding first guide surface;

(c) a cover unit openably connectable to the base panel and having latch means for holding the cover unit in a closed position relative to the base panel, the cover unit having a front wall portion and respective side wall portions;

(d) a pair of parallel spaced cover track members rigidly extending in facing relation relative to corresponding ones of the side wall portions, each cover track member having a first guide surface segment, a second guide surface segment, and a transition segment wherein, when the cover unit is in the closed position, the first guide surface segments of the respective base and cover track segments extend in approximately uniformly spaced relation, the second guide surface segments of the respective base and cover track segments extend in approximately uniformly spaced relation, and the transition segments extend in concave relation between proximal ends of the first and second guide surface segments of the cover track members thereby to form respective L-shaped track passages; and (e) a mandrel unit having a parallel-spaced pair of mandrel portions and a bridge portion rigidly connecting the mandrel portions, the mandrel unit being locatable between the base panel and the cover unit with opposite ends of each mandrel portion guidable within respective ones of the track passages in the closed position of the cover unit, one of the mandrel portions being movable between a first dispensing position to an expended position, the other of the mandrel portions being correspondingly moved from a reserve position to a second dispensing position.

2. The apparatus of claim 1, wherein further guide surface segments of the base and cover define respective extensions of the corresponding track passages, the expended position of the mandrel portion being within the extensions.

3. The apparatus of claim 1, further comprising a catch member for holding the mandrel portion in the expended position thereof.

4. Apparatus for dispensing sheet material from a plurality of cored rolls, comprising:

(a) an openable housing having opposite side portions and a front opening, a parallel-spaced pair of guide slots being supported proximate respective ones of the side portions, each guide slot having a generally vertically oriented first segment, a generally horizontally oriented second segment intersecting the first segment, and a generally vertically oriented third segment intersecting the second segment in offset relation to the first segment, the first segment having a bottom extremity below the second segment;

(b) a mandrel member having a parallel-spaced pair of mandrel portions for receiving respective ones of the rolls, and a bridge portion rigidly connecting the mandrel portions, the mandrel member when loaded with the rolls being locatable with opposite ends of each mandrel portion guidable within respective ones of the guide slots:

(i) from a first position wherein a lowermost of the mandrel portions is in a first dispensing position at the bottom extremity of the first segment, and an uppermost of the mandrel portions is in a reserve position within the first segment; and, following substantial consumption of the sheet material from the lowermost mandrel, (ii) to a second position wherein the lowermost of the mandrel portions is in an expended position at a bottom extremity of the third segment of the guide slot, and the uppermost of the mandrel portions is in a second dispensing position within the first segment; and (c) a catch member biasingly coupled to the housing for retaining the lowermost of the mandrel portions in the expended position.

5. The apparatus of claim 4, wherein a base panel is effective for preventing engagement of the lowermost mandrel portion with the third segment of the guide slot until the sheet material is substantially consumed therefrom.

6. The apparatus of claim 4, wherein each mandrel portion has a latch surface formed thereon for engagement by the catch member when the mandrel member is engaging the guide slot with one mandrel portion in the expended position, the engagement of the latch surface by the catch member locking the one mandrel portion in the expended position.

7. The apparatus of claim 4, wherein the mandrel member is locatable in the guide slots with either of the mandrel portions being the lowermost mandrel portion.

8. The apparatus of claim 7, wherein the mandrel member is locatable in the guide slots with either end extremity of each mandrel portion being within either of the guide slots.

9. The apparatus of claim 4, wherein the housing comprises a base portion and a cover portion, the cover portion having open and closed positions relative to the base portion, opposite sides of the first segments of each guide slot being formed respectively in the base and cover portions, whereby the mandrel member is laterally separable from the housing in the open position of the cover portion.

10. The apparatus of claim 9, wherein the cover portion is separable from the base portion, the mandrel member being lowerable into the cover portion to stable engagement with portions of the first segments of the guide slot, the mandrel member remaining in the stable engagement during movement of the cover portion to the closed position thereof.

11. The device of claim 9, wherein the cover portion is pivotally connected to the base portion, the mandrel member being lowerable into the cover portion to stable engagement with portions of the first segments of the guide slot, the mandrel member remaining in the stable engagement during movement of the cover portion to the closed position thereof.

12. A method for dispensing sheet material from a plurality of cored rolls thereof, comprising the steps of:

(a) providing a dispenser having a dual mandrel and a housing, the housing including a base portion and an openable cover portion having a closed position, opposite guide slots being formed between respective guide surfaces of the base portion and the cover portion in the closed position thereof for defining respective first and second dispensing positions, a reserve position, and an expended position for the rolls;

(b) loading a pair of the rolls on respective portions of the mandrel;

(c) opening the cover portion to an orientation wherein the guide surfaces thereof are upwardly facing;

(d) lowering the mandrel into engagement with the guide surfaces of the cover portion; and (e) closing the cover portion with the rolls in the first dispensing and reserve positions thereof.

13. The method of claim 12, comprising the further steps of:

(a) unrolling and separating material from the roll having the first dispensing position until substantially all of the material is removed therefrom;

(b) moving the mandrel until a portion thereof is in the expended position, the roll in the reserve position being thereby moved to the second dispensing position; and (c) retaining the roll in the second dispensing position.

* * * * *